US007389736B2

(12) United States Patent
Dyhrberg

(10) Patent No.: US 7,389,736 B2
(45) Date of Patent: Jun. 24, 2008

(54) MOORING SYSTEM

(76) Inventor: Roger Dyhrberg, 13 Possner Way, Henderson WA (AU) 6166

( * ) Notice: Subject to any disclaimer, the term of this patent is extended or adjusted under 35 U.S.C. 154(b) by 0 days.

(21) Appl. No.: 11/324,885

(22) Filed: Jan. 4, 2006

(65) Prior Publication Data

US 2006/0112871 A1 Jun. 1, 2006

Related U.S. Application Data

(62) Division of application No. 10/475,273, filed as application No. PCT/AU02/00502 on Apr. 19, 2002.

(30) Foreign Application Priority Data

Apr. 19, 2001 (AU) ..... PR4489

(51) Int. Cl.

| | |
|---|---|
| ***B63B 21/00*** | (2006.01) |
| *B63B 22/02* | (2006.01) |
| *B63B 22/04* | (2006.01) |
| *B63B 22/18* | (2006.01) |

(52) U.S. Cl. ..... 114/230.1; 114/230.13

(58) Field of Classification Search ..... 114/293, 114/294, 230.1, 230.2, 230.13; 135/118; 52/155, 156; 405/224

See application file for complete search history.

(56) References Cited

U.S. PATENT DOCUMENTS

| | | | | |
|---|---|---|---|---|
| 292,129 | A | 1/1884 | Moore | 52/157 |
| 2,117,798 | A * | 5/1938 | Gascoigne et al. | 403/174 |
| 2,403,539 | A | 7/1946 | Mehl, Jr. | 441/16 |
| 3,259,927 | A | 7/1966 | Albert | 441/3 |
| 3,950,806 | A | 4/1976 | Puchois | |
| 4,249,715 | A * | 2/1981 | Repp | 248/545 |

(Continued)

FOREIGN PATENT DOCUMENTS

| | | |
|---|---|---|
| AU | B-79846/94 | 12/1998 |

(Continued)

OTHER PUBLICATIONS

Patent Abstracts of Japan, vol. 008, No. 132 (M-303), Jun. 20, 1984 & JP 59 032587 A (Hitachi Zosen KK), Feb. 22, 1984.

Patent Abstracts of Japan, vol. 1995, No. 07, Aug. 31, 1995 & JP 07 101382A (Zeniraito V:KK), Apr. 18, 1995.

*Primary Examiner*—Ajay Vasudeva

(74) *Attorney, Agent, or Firm*—Ostrolenk, Faber, Gerb & Soffen, LLP

(57) ABSTRACT

An offset anchoring system for anchoring objects to a floor of a body of water includes T-shaped anchor members arranged in a cluster. Each anchor member having an elongate first and second beams. The second beam, having longitudinal ends, extends transverse to the first beam. The first beam being disposable in the floor. The system also includes a coupling member to which the anchor members being coupled at respective longitudinal ends such that the substantially T-shaped anchor members are arranged in a cluster with the coupling member being disposed substantially centrally of the anchor members and with the second beams extending substantially radially of the coupling member. When the first beams are driven into the floor and a load is applied to the coupling member, the load is offset from a longitudinal axis of each the first beam thereby increasing the holding power of the anchoring system.

6 Claims, 5 Drawing Sheets

U.S. PATENT DOCUMENTS

| | | | | | |
|---|---|---|---|---|---|
| 4,281,613 | A | | 8/1981 | Ray et al. | 114/230.23 |
| 4,420,918 | A | | 12/1983 | Arnoux et al. | 52/157 |
| 4,726,313 | A | | 2/1988 | Neal | 114/230 |
| 4,813,815 | A | | 3/1989 | McGehee | 405/202 |
| 5,076,032 | A | * | 12/1991 | Lehman | 52/169.13 |
| 5,257,592 | A | | 11/1993 | Schaefer | 114/215 |
| 5,305,976 | A | * | 4/1994 | Blanchard | 248/156 |
| 5,492,294 | A | * | 2/1996 | Haeussler | 248/229.1 |
| 5,716,249 | A | | 2/1998 | Dyhrberg | 441/3 |
| 5,902,163 | A | | 5/1999 | Baruzzi et al. | 441/23 |
| 6,142,453 | A | * | 11/2000 | Martin | 256/65.05 |
| 6,209,853 | B1 | * | 4/2001 | Roy et al. | 256/10 |
| D446,838 | S | | 8/2001 | Carey | D21/840 |
| 6,481,364 | B2 | | 11/2002 | Woyjeck | 114/294 |

FOREIGN PATENT DOCUMENTS

| | | | |
|---|---|---|---|
| DE | 29716489 | U1 | 12/1997 |
| JP | 59-032587 | | 2/1984 |
| JP | 04019363 | A | 1/1992 |
| JP | 07-081669 | | 3/1995 |
| JP | 07-101382 | | 4/1995 |
| JP | 2003/160095 | A | 6/2003 |
| WO | 95/11158 | | 4/1995 |

* cited by examiner

MOORING SYSTEM

CROSS-REFERENCE TO RELATED APPLICATIONS

This is a divisional of U.S. patent application Ser. No. 10/475,273, filed Mar. 22, 2004 and entitled MOORING SYSTEM.

BACKGROUND OF THE INVENTION

The present invention relates to an improved mooring system, and to an offset anchoring system for anchoring an object to a sea bed floor and which can be used in conjunction with the improved mooring system.

Conventional moorings comprise a base which is fixed to the sea bed, and a length of chain or the like fixed at one end to the base and fixed at the other end to a mooring line supported from the surface of the water by a buoy. A mooring line of a vessel may be attached to the buoy when mooring the vessel. When a vessel is attached to the buoy, the base and chain serve to prevent movement of the vessel away from the mooring. The function of the chain is to absorb the inertial load created by the movement of the vessel away from the mooring as a result of water conditions by providing a reaction to the forces applied by the vessel. As the load applied by the vessel increases, so more of the chain will be lifted from the sea bed. When maximum load has been applied by the vessel, the chain is lifted free of the sea bed and the load of the chain is fully applied to the base.

A disadvantage of the above-described arrangement is the amount of space that must be provided between moorings in order to allow the free movement of a vessel under extreme water conditions. A further disadvantage of such prior art moorings is that as the vessel swings about the mooring, due to changing wind, tidal and wave conditions, the chain is dragged over the sea bed around the mooring. This results in erosion of the sea bed around the mooring base, and damages any sea grass, coral and other marine life that may be growing in the region surrounding the mooring base.

Australian Patent No. 688397 describes a mooring means having a sheave adapted to be mounted to a base which is located on the sea bed. A cable received in the sheave has one end adapted to be connected to the mooring line of a vessel and the other end is connected to a first buoy. A second buoy is attached to the cable between the sheave and the one end. The second buoy has a buoyancy less than that of the first buoy and is positioned on the cable such that under a no load condition it is submerged and lies adjacent the cable between the sheave and first buoy. The buoyancy of the first buoy is sufficient to accommodate the anticipated loading of the mooring. A counteracting tension is provided by the second buoy against the first buoy which serves to retain all of the pendant assembly of the mooring line above the sea bed floor. As a result, damage to the sea bed floor is minimised with this system. However, in practice over extended periods, it was found that the sheave becomes encrusted with debris and the cable is no longer free to run through the sheave.

The present invention was developed with a view to providing an improved mooring system that is less susceptible to the problems encountered in the pnor art.

For the purposes of this specification it will be clearly understood that the word "comprising" means "including but not limited to", and that the word "comprises" has a corresponding meaning. Throughout this specification the term "sea bed" should be taken to include the bottom of any large body of water, including a river bed or lake bed.

SUMMARY OF THE INVENTION

According to one aspect of the present invention there is provided an improved mooring system for mooring a vessel to the sea bed, the system comprising a substantially rigid, elongate support member having a connecting point adjacent an upper end thereof to which a vessel can be connected, and being coupled adjacent a lower end thereof to an anchor on said floor portion; a displacement buoy slidably received on said support member such that the displacement buoy is capable of moving up and down said support member with wave movement; and an elongate resilient member operatively associated with the buoy such that upwards movement of the displacement buoy causes said resilient member to stretch, wherein, during use, the support member extends in a substantially vertical orientation in a body of water and, when the support member is urged to move off vertical, the buoy is urged by the surrounding water to slide up the support member and cause said resilient member to stretch, said resilient member thereby producing a self-centering force which acts to bias the support member to return to the substantially vertical orientation in the body of water.

In one arrangement, the resilient member includes a first end coupled to the displacement buoy and a second opposite end coupled to the support member adjacent said lower end.

Alternatively, the mooring system includes a telescopic device having a first portion connected to the support member and a second portion connected to said anchor, said first portion being slidable relative to said second portion, and said resilient member being connected between said first and second portions. The first portion may be connected to the support member through at least one chain.

Preferably, the buoy includes a bore extending through said buoy, and said support member is in the form of a shaft slidably received in the bore.

Preferably first and second wear bushes are fixed to the buoy at respective ends of the bore, and the buoy is slidably supported on the shaft by means of these wear bushes.

Typically, said resilient member comprises a length of UVC resistant rubber strap. For larger vessels, additional rubber straps can be attached in parallel with the first rubber strap to increase the return force applied to the displacement buoy.

Typically the lower end of the stainless steel shaft is coupled to an anchor on the sea bed floor via a chain connection. Preferably the length of chain employed to connect the lower end of the stainless steel shaft to the anchor on the sea bed floor is selected so that the load produced by the rubber strap lifts the chain off the sea bed floor and thereby minimizes environmental damage.

In one variation, the mooring system further includes a beacon disposed adjacent said upper end of the support member.

In a further variation, the mooring system further includes a pump mechanism operatively associated with the displacement buoy such that movement of the displacement buoy relative to the support member effects operation of the pump mechanism. The pump mechanism may include a cylinder connected to the displacement buoy and a piston connected to the support member, the piston being slidably received in the cylinder and being moveable relative to the cylinder as the displacement buoy moves relative to the support member.

According to another aspect of the present invention there is provided an offset anchoring system for anchoring objects to a sea bed floor, the system comprising:

a plurality of substantially T-shaped anchor members arranged in a cluster, each anchor member having an elongate first beam having first and second longitudinal ends and an elongate second beam extending in a substantially transverse direction relative to the first beam, said first beam being disposable in said floor portion, and a coupling member, the plurality of said T-shaped anchor members being arranged in a cluster such that first longitudinal ends of the second beams are coupled together by the coupling member, said coupling member facilitating attachment of a chain thereto, whereby, in use, when a load is applied to said coupling member, the load is offset from a longitudinal axis of each of said first beams thereby increasing the holding power of said anchor member.

Preferably a transverse plate is provided on the first beam substantially perpendicular to the plane of the second beam, and typically on the upper half of the first beam, to provide resistance to transverse movement of the T-shaped anchor member in a direction parallel to the plane of the T-shaped anchor member.

Typically the cluster is formed by driving the first beams of three anchor members into the sea bed floor at three equidistant points, with each second beam arranged radially at an angle of 120° with respect to the second beams of the adjacent anchor members. In the preferred embodiment, the mechanical coupling comprises a triangular fish plate.

Advantageously the capacity of the anchoring system may be further increased by coupling additional T-shaped anchor members to the cluster. Typically in such an extended multipoint system a plurality of triangular clusters are mechanically coupled together by a suitable mechanical coupling.

Other features and advantages of the present invention will become apparent from the following description of the invention which refers to the accompanying drawings.

BRIEF DESCRIPTION OF THE DRAWING(S)

In order to facilitate a more detailed understanding of the nature of the invention preferred embodiments of the improved mooring system and of said anchor system will now be described in detail, by way of example only, with reference to the accompany drawings, in which.

Figure 1:
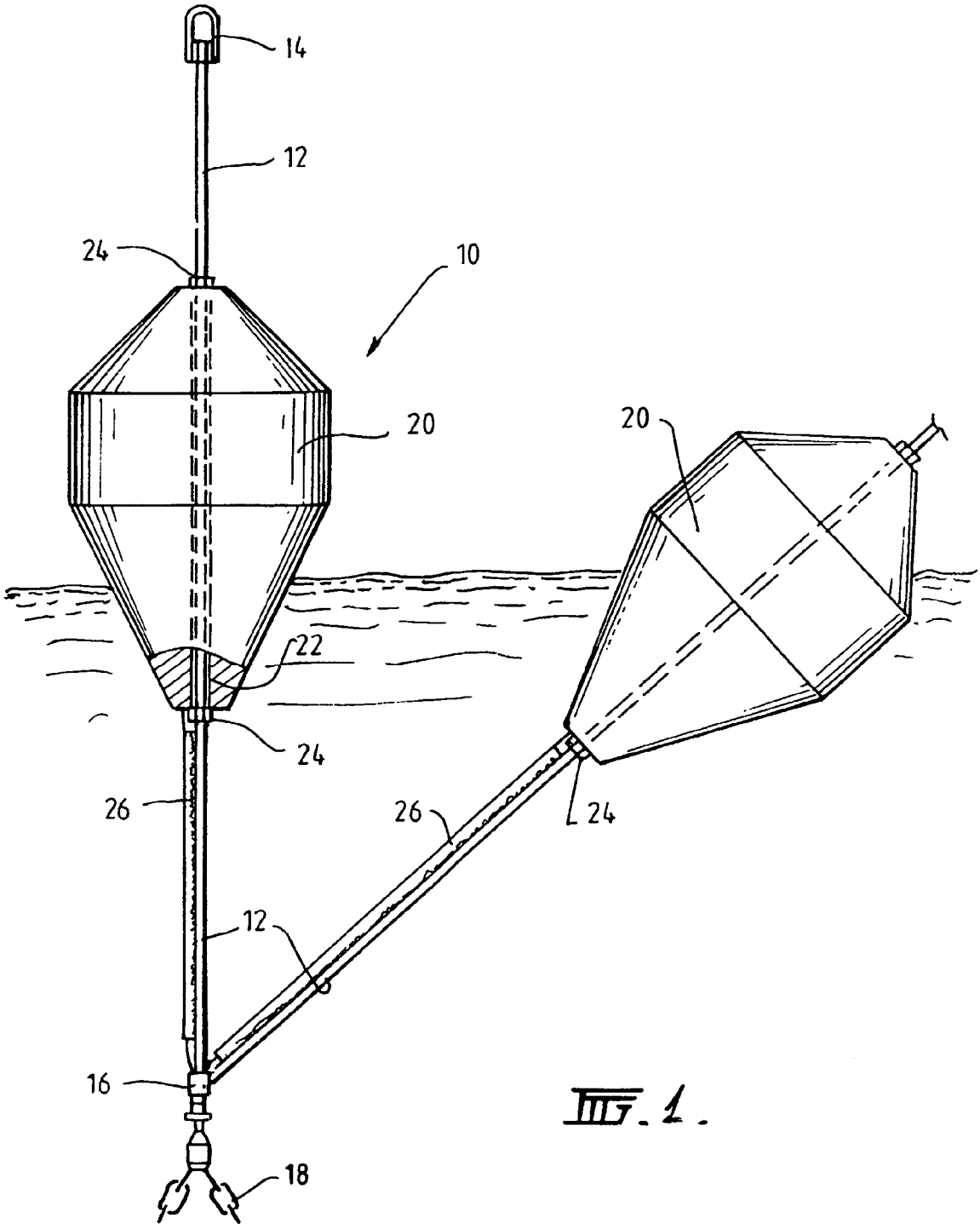
FIG. 1 illustrates an embodiment of a mooring system in accordance with the present invention.
Figure 4:
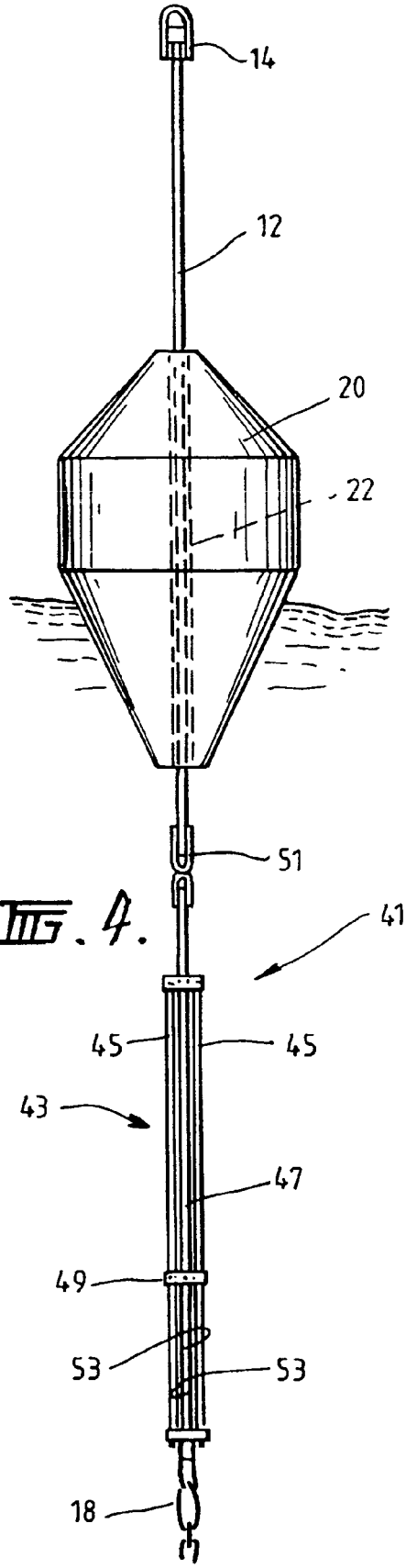
Figure 3:
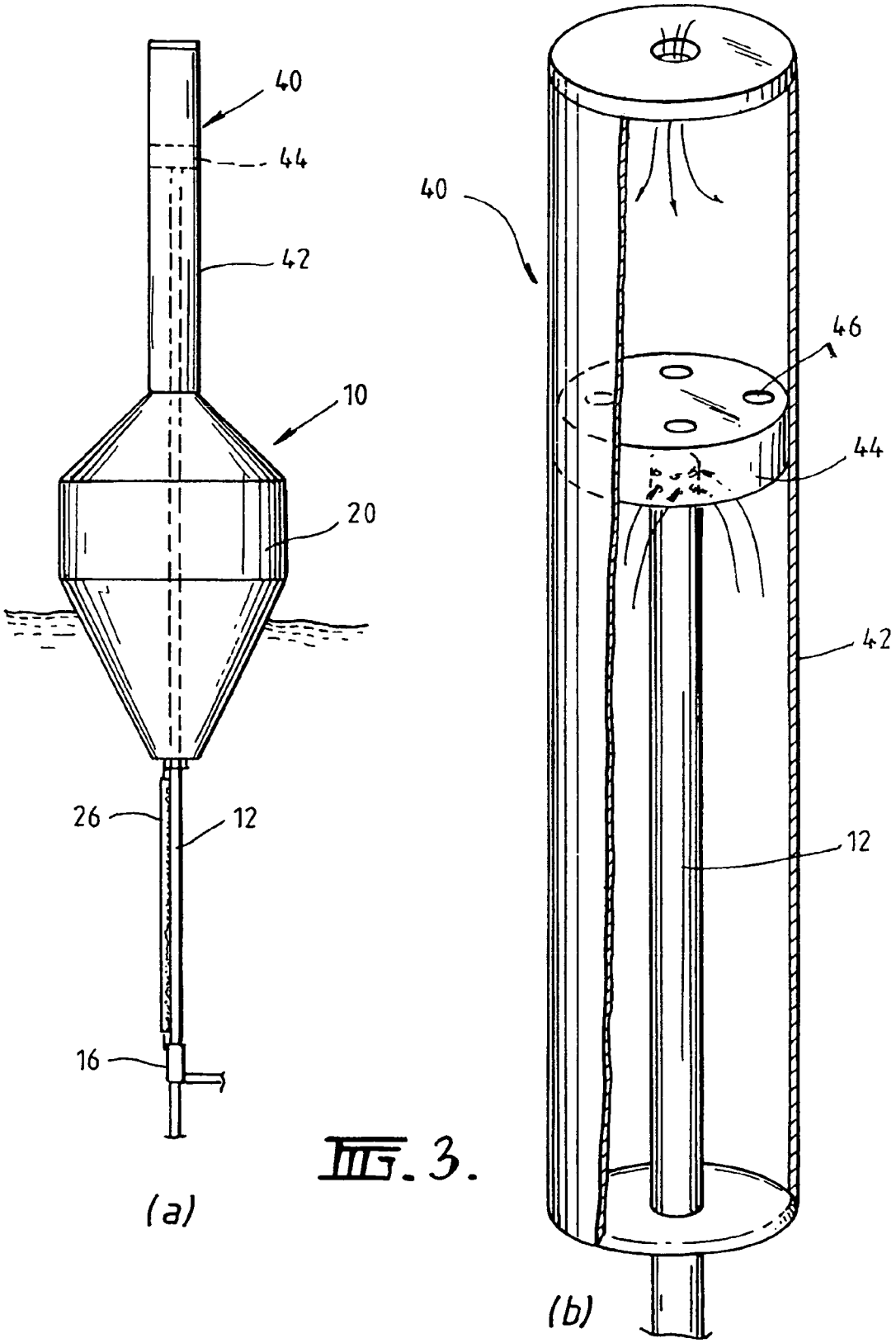
Figure 5:
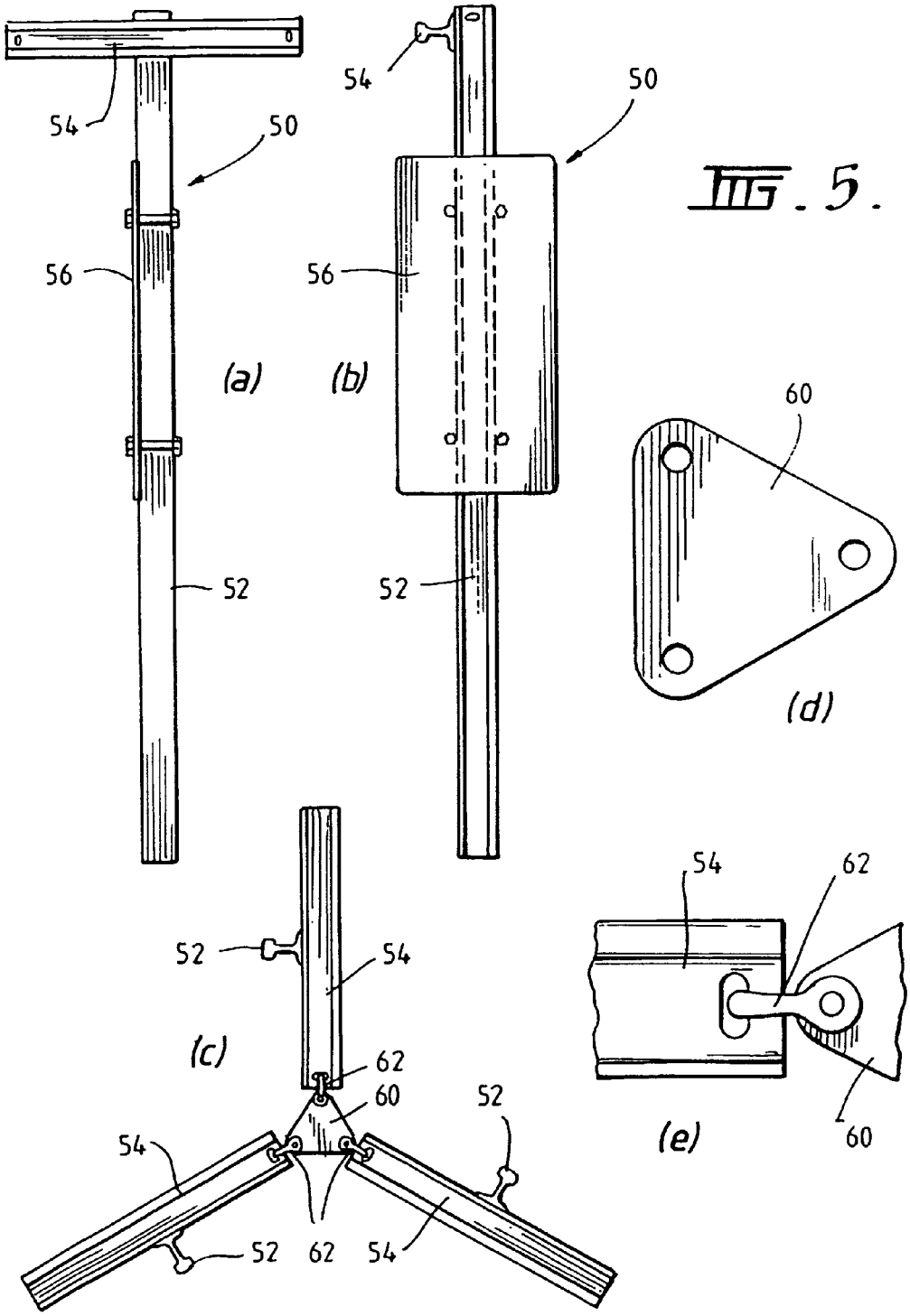
Figure 6:
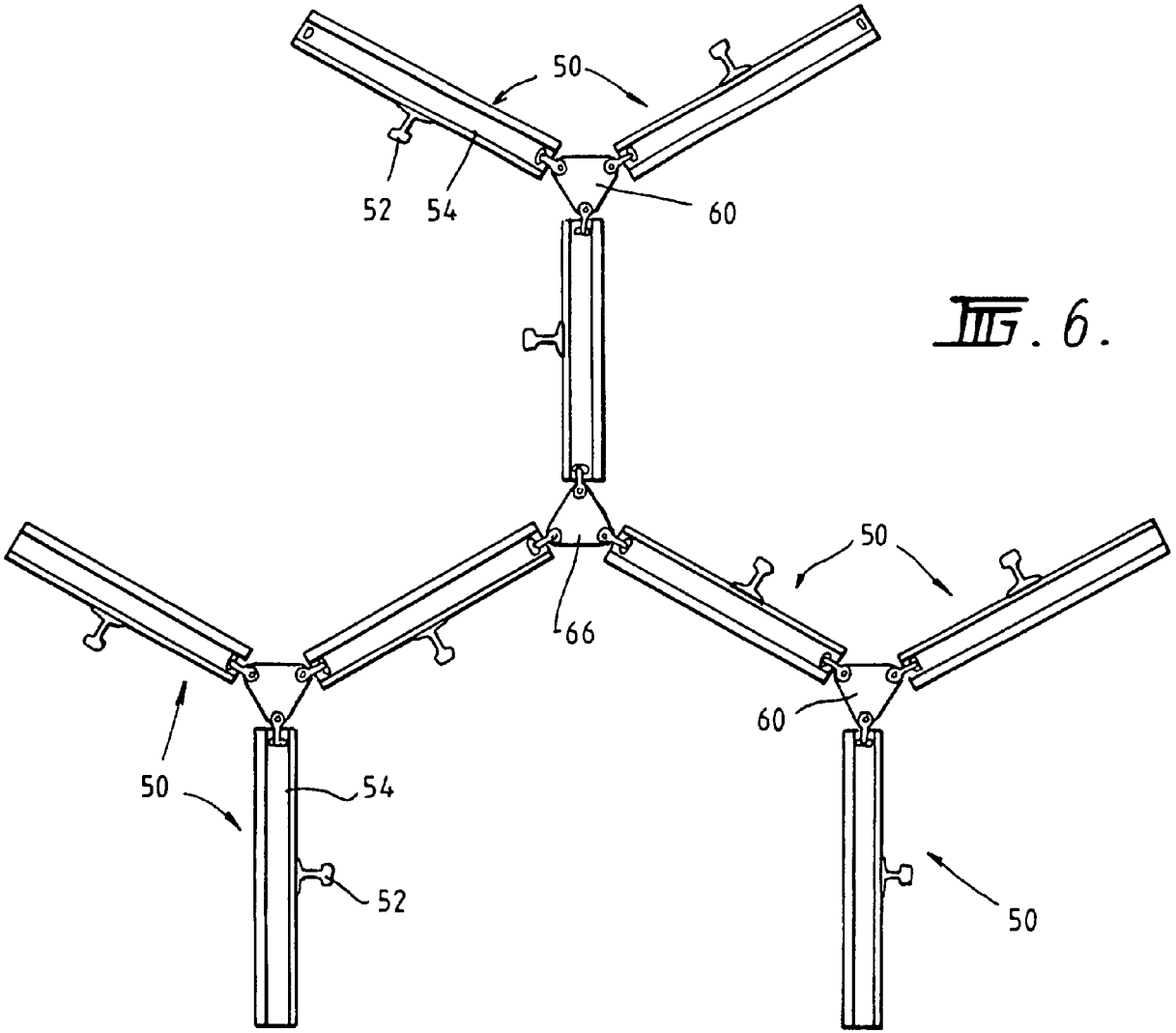

FIGS. 3 (*a*) and (*b*) illustrate the mooring system of FIG. 1 incorporating a pump to harness wave energy;

FIG. 4 illustrates an alternative embodiment of a mooring system in accordance with the present invention;

FIGS. 5 (*a*), (*b*), (*c*), (*d*) and (*e*) illustrate an embodiment of the anchoring system in accordance with the present invention; and, FIG. 6 illustrates how the anchoring system of FIG. 5 can be extended to increase the capacity of the anchoring system.

DETAILED DESCRIPTION OF PREFERRED EMBODIMENTS OF THE INVENTION

An embodiment of the mooring system 10 as illustrated in FIG. 1 comprises a substantially rigid, elongate support member, in this example in the form of a stainless steel shaft 12. At an upper end of the shaft 12 a stainless steel swivel 14 provides a connecting point to which a mooring line of a vessel, such as a boat, can be connected to moor the vessel to the sea bed. A lower end 16 of the stainless steel shaft 12 is coupled to an anchor (not shown) on the sea bed floor via a chain connection 18. A displacement buoy 20 is slidably received on the stainless steel shaft 12 and is adapted to slide up and down the shaft 12 in response to tidal and wave movement. In the illustrated embodiment, the displacement buoy has a buoyant capacity of 230 kg and comprises a central cylindrical section with a frustoconical section at the top and the bottom respectively of the cylindrical section. The stainless steel shaft 12 is slidably received in a central bore 22 that passes vertically through the buoy substantially coaxial with its center vertical axis. First and second nylon wear bushes 24 are fixed to the buoy at the top and bottom respectively of the central bore 22. The buoy 20 is slidably supported on the shaft 12 by means of these wear bushes 24. Preferably, a short length of rubber hose is positioned on the shaft 12 immediately below the swivel 14 to soften the impact of the buoy 20 when it reaches its upper limit of travel on shaft 12 during wave movement.

The mooring system 10 further comprises an elongate flexible, resilient member 26 having one end coupled to the buoy 20 and the other end fixed to the shaft 12 adjacent its lower end 16. In the described embodiment, the resilient member 26 comprises a length of UVC resistant rubber strap, similar to that employed in a spear gun, which is approximately 20 mm in diameter and 700 mm in length in its unstretched condition. When the stainless steel shaft 12 is pulled off vertical, for example by a load applied to the swivel 14 from a moored vessel, the buoyancy of the buoy 20 forces it to slide up the shaft 12 causing the rubber strap 26 to stretch as shown in FIG. 1. The resilience of the rubber strap 26 produces a self-centring action by pulling the buoy 20 downwards and which in turn enables the stainless steel shaft 12 to return to an upright position in the water. If the load applied to the swivel 14 is sufficiently large, the buoy 20 will eventually be submerged below the water surface. The buoyancy of the buoy 20 together with the self-centering action produced by the rubber strap 26 produces a reverse catenary effect that absorbs the vessel's inertia. For larger vessels, additional rubber straps can be attached in parallel with the rubber strap 26 to increase the return force applied to the displacement buoy 20.

Figure 2:
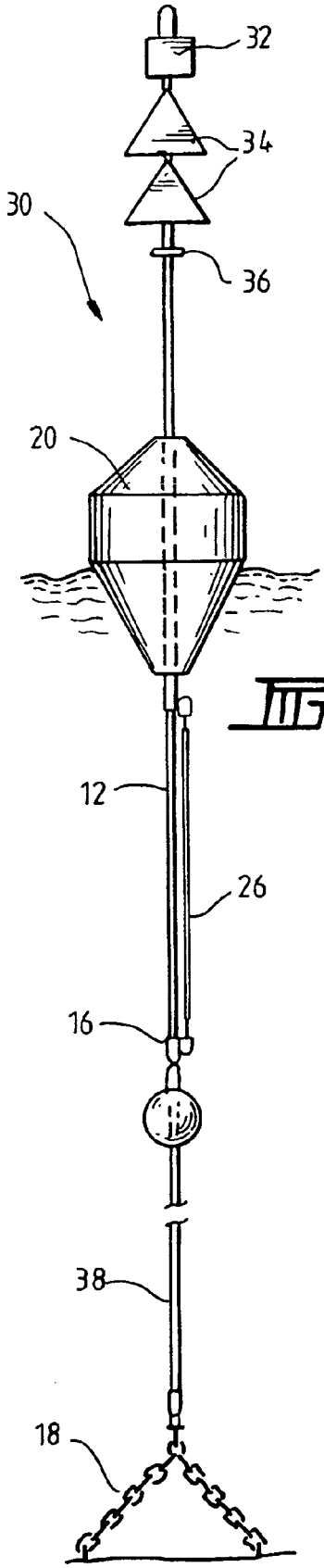
FIG. 2 illustrates an application of the mooring system of FIG. 1 to a sea beacon.

Preferably, the length of chain 18 employed to connect the lower end 16 of the stainless steel shaft 12 to the anchor on the sea bed floor is selected so that the load produced by the rubber strap 26 lifts the chain off the sea bed floor and thereby minimizes environmental damage. FIG. 2 illustrates a beacon system 30 that employs a modified form of the mooring system 10 of FIG. 1. Similar parts in FIG. 2 are identified with the same reference numerals as in FIG. 1, and will not be described again. In this embodiment, the stainless steel shaft 12 is of increased length and has a beacon 32, of the kind used for marine navigation, fixed to the top end thereof. Cardinal marks 34 are also fixed to the top end of the shaft 12 below the beacon 32 to clearly identify the beacon during daylight hours. A stainless steel stop ring 36 is welded to the shaft 12 just below the cardinal marks 34 to define the upper limit of the sliding movement of the displacement buoy 20. In the illustrated embodiment, the buoy 20 has a five meter tidal and wave range of movement. In the illustrated embodiment a stainless steel extension shaft 38 is provided to connect the lower end 16 of the shaft 12 to the chains 18 connecting the beacon/mooring system to the sea bed floor. Alternatively, a chain or rope may be used to provide an extension in deep waters. The self-centering action produced by the rubber strap 26 ensures that the beacon 32 maintains its approximate datum relative to the sea bed floor.

FIG. 3 illustrates the mooring system 10 of FIG. 1 with a pump mechanism 40 incorporated therein. FIG. 3 (*b*) is an enlarged partial cut-away view of the pump mechanism 40 which comprises a cylinder 42 having a piston 44 slidably received therein. Cylinder 42 is approximately 1.0 m in length and 200 mm in diameter and is fixed to the upper end of the displacement buoy 20. Piston 44 is connected to the top end of the stainless steel shaft 12 and therefore slides up and down within the cylinder 42 as the buoy 20 moves up and down with wave movement. A plurality of one way valves 46 are provided within the piston 44 to permit a working fluid to pass through the piston during a return stroke of the piston 44. Either air, water or hydraulic fluid may be employed as the working fluid in the pump mechanism 40. A fluid inlet and outlet (not illustrated) provided at each end of the cylinder 42 may be used to supply and draw off the working fluid from the cylinder 42. Pressurized working fluid drawn off during a compression stroke of the piston 44 may be used, for example, to drive a hydraulic motor or a small dynamo.

An alternative embodiment of a mooring system is shown in FIG. 4. Like features are indicated with like reference numerals.

The alternative mooring system 41 is similar to the mooring system 10 shown in FIGS. 1 to 3 in that a displacement buoy 20 is slidably received on a shaft 12 so that the displacement buoy 20 is able to slide up and down the shaft 12 in response to tidal and wave movements. However, instead of resilient members extending between the displacement buoy 20 and a lower end of a shaft 12, the mooring system 41 includes a telescopic device 43 extending between the shaft 12 and the chain connection 18.

The telescopic device 43 includes two elongate outer shafts 45 connected at a lower end of the outer shafts 45 to the chain connection 18, and an elongate inner shaft 47 extending between the two outer shafts 45 and connected at a lower end of the inner shaft 47 to a sliding bush 49 slidably received on the outer shafts 45. An upper end of the inner shaft 47 is connected to a lower end of the shaft 12 by any suitable connection mechanism, in this example by chains 51. The telescopic device 43 also includes elongate resilient members 53, in this example in the form of rubber straps, the resilient members 53 extending between the sliding bush 49 and a lower end of the outer shafts 45.

In operation, the displacement buoy 20 is free to move relative to the shaft 12 as a result of tidal movements, wave movements or forces exerted by a vessel moored to the swivel 14 until the displacement buoy contacts the swivel 14. When this occurs, further forces exerted on the displacement buoy 20 will cause the inner shaft 47 and the sliding bush 49 to move upwards relative to the outer shafts 45, thereby causing the rubber straps 53 to stretch. This creates a self-centering action which absorbs a vessel's inertia and biases the mooring system 41 back towards a vertical orientation. The improved mooring system 10, 41 may be anchored to the sea bed floor using any suitable prior art anchoring system. Preferably, the mooring system is anchored to the sea bed floor using an anchoring system in accordance with the present invention. A preferred embodiment of the anchoring system in accordance with the present invention will now be described with reference to FIGS. 5 and 6.

As shown in FIGS. 5 (*a*) and (*b*), a preferred embodiment of the anchoring system comprises a T-shaped anchor member 50 having an elongate, vertical beam 52 and a shorter elongate, horizontal beam 54 fixed transverse to and approximate a top end of the vertical beam 52. In the illustrated embodiment, both the vertical beam 52 and horizontal beam 54 are constructed out of 80 lb or 100 lb railway line. The hardened steel, from which the railway line is manufactured, ensures long life and means that each T-shaped anchor member typically weighs a minimum of 140 kg. The vertical beam 52 is designed to be buried in the floor of the sea bed and either end of the horizontal beam 54 is designed to have a mooring chain attached thereto. Hence, when a load is applied to the anchor member 50 via one of the mooring chains (not shown) the upward force applied to the T-shaped anchor member 50 is offset from the longitudinal axis of the vertical beam 52. This greatly increases the holding power of the anchor member 50.

Preferably, a transverse plate 56 is bolted onto the vertical beam 52 substantially perpendicular to the plane of the horizontal beam 54, and typically on the upper half of the vertical beam 52. The purpose of transverse plate 56 is to provide resistance to transverse movement of the T-shaped anchor member 50 in a direction parallel to the plane of the T-shaped anchor member 50.

As the load on the T-shaped anchor member 50 is offset, there is no need to grout the anchor member in the sea bed, even in limestone. Hence, the anchor member 50 may be removed for inspection or repositioned if desired. Each anchor member 50 develops a holding power of approximately 53% of its own weight in sand. A single anchor member 50 has a tested "pullout load" of seven ton in sand. Whilst the anchoring system will work well with even a single T-shaped anchor member 50, two, three or more T-shaped anchor members may be employed in a multi-point system to increase the required holding capacity.

FIG. 5 (*c*) illustrates one embodiment of a multi-point anchoring system, in which three T-shaped anchor members 50 are arranged in a triangular cluster. The cluster is formed by burying the vertical beams 52 of three anchor members 50 into the sea bed floor at three equidistant points, with each horizontal beam 54 arranged radially at an angle of 120° with respect to the horizontal beams of the adjacent anchor members. The inner ends of the horizontal beams 54 are coupled together by a suitable mechanical coupling. In the illustrated embodiment, the mechanical coupling comprises a triangular fish plate 60, shown in greater detail in FIG. 5 (*d*). Respective shackles 62 are used to join the ends of the horizontal beams 54 to the fish plate 60 as shown in greater detail in FIG. 5 (*e*). A single mooring chain (not shown) may be connected to a center connection point provided on the fish plate 60. Alternatively, three chains may be connected to the free ends of each of the horizontal beams 54 and joined together to form a single connecting point for the mooring chain. In either case, it will be appreciated that the load applied to the anchoring system is offset from the longitudinal axis of the vertical beams 52, and this together with the use of a multi-point arrangement greatly increases the holding power of the anchoring system.

The vertical beams 52 of the anchor members are typically jetted or drilled into the sea bed floor. Alternatively, they may be driven into the sea bed floor using an underwater pile driving hammer.

The capacity of the anchoring system may be further increased by coupling additional T-shaped anchor members to the multi-point arrangement of FIG. 5 (*c*). FIG. 6 illustrates such an extended multi-point system in which three triangular clusters, similar to that shown in FIG. 5 (*c*) are mechanically coupled to a fourth central fish plate 66.

Now that preferred embodiments of the improved mooring system and offset anchoring system of the present invention have been described in detail, it will be apparent that they provide a number of significant advantages, including the following:

(i) The mooring system is lightweight and low maintenance as there are few moving parts that can fail;

(ii) All components of the mooring system are manufactured from heavy duty corrosion resistant materials;

(iii) The mooring system may be anchored by a variety of conventional anchoring systems.

(iv) The mooring system is environmentally low impact and may be installed in areas containing sea grass or coral reef, (v) The self-centering action of the mooring system reduces swing by up to 50% and results in a smoother ride on board the moored vessel.

(vi) The offset anchoring system is of simple construction and manufactured from heavy duty components;

(vii) The multi-point anchoring system becomes inter-supporting, substantially increasing the holding capacity;

(viii) The anchoring system may be installed as a single point or multi-point system depending on the required holding capacity;

(ix) No grouting is required, even in limestone, so that the anchor members can be removed for inspection or repositioned if desired.

Numerous variations and modifications will suggest themselves to persons skilled in the marine engineering arts, in addition to those already described, without departing from the basic inventive concepts. For example, the displacement buoy 20 may be of any desired shape and capacity depending on the particular application of the mooring system. Furthermore, whilst in the preferred embodiment one or more rubber straps are employed, any suitable resilient member may be employed to produce the self-centering action. All such variations and modifications are to be considered within the scope of the present invention, the nature of which is to be determined from the foregoing description.

Although the present invention has been described in relation to particular embodiments thereof, many other variations and modifications and other uses will become apparent to those skilled in the art. Therefore the present invention should be limited not by the specific disclosure herein, but only by the appended claims.

What is claimed is:

1. An offset anchoring system for anchoring objects to a floor portion of a body of water, the system comprising:

a plurality of substantially T-shaped anchor members arranged in a cluster, each anchor member having an elongate first beam having first and second longitudinal ends and an elongate second beam extending in a substantially transverse direction relative to the first beam, said first beam being disposable in said floor portion; and a coupling member, the plurality of substantially T-shaped anchor members being arranged in a cluster such that first longitudinal ends of the second beam are coupled together by the coupling member, said coupling member facilitating attachment of a linking member thereto, whereby, in use, when a load is applied to said coupling member, the load is offset from a longitudinal axis of each said first beams thereby increasing the holding power of said anchor member, wherein the cluster is formed by driving said first beams of three anchor members into said floor partition at three substantially equidistant points, with each second beam arranged radially at an angle of substantially 120° with respect to the second beams of the adjacent anchor members.

2. A system as claimed in claim 1, wherein a transverse plate is provided on the first beam substantially perpendicular to the plane of the second beam so as to provide resistance to transverse movement of the anchor member in a direction parallel to the plane of the anchor member.

3. An offset anchoring system for anchoring objects to a floor portion of a body of water, the system comprising:

a plurality of substantially T-shaped anchor members arranged in a cluster, each anchor member having an elongate first beam having first and second longitudinal ends and an elongate second beam extending in a substantially transverse direction relative to the first beam, said first beam being disposable in said floor portion; and a coupling member, the plurality of substantially T-shaped anchor members being arranged in a cluster such that first longitudinal ends of the second beam are coupled together by the coupling member, said coupling member facilitating attachment of a linking member thereto, whereby, in use, when a load is applied to said coupling member, the load is offset from a longitudinal axis of each said first beams thereby increasing the holding power of said anchor member, wherein the coupling member comprises a triangular fish plate.

4. An underwater anchoring system for anchoring objects to a floor portion of a body of water. the system comprising:

a plurality of substantially T-shaped anchor members arranged in a cluster, each anchor member having an elongate first beam and an elongate second beam, the second beam having longitudinal ends and extending in a substantially transverse direction relative to the first beam, said first beam being disposable in said floor portion; and a coupling member, the plurality of substantially T-shaped anchor members being coupled to the coupling member at respective longitudinal ends of the second beams such that the substantially T-shaped anchor members are arranged in a cluster with the coupling member being disposed substantially centrally of the anchor members and with said second beams extending substantially radially of the coupling member; and a linking member attached to the coupling member;

whereby, in use, when said first beams of said anchor members are driven into said floor portion and a load is applied to said linking member, the load is offset from a longitudinal axis of each said first beam thereby increasing the holding power of said anchoring system;

wherein three of the anchor members are provided, the second beams being disposed substantially equidistantly relative to the coupling member with each second beam arranged radially at an angle of substantially 120° with respect to an adjacent second beam.

5. An underwater anchoring system for anchoring objects to a floor portion of a body of water, the system comprising:

a plurality of substantially T-shaped anchor members arranged in a cluster, each anchor member having an elongate first beam and an elongate second beam, the second beam having longitudinal ends and extending in a substantially transverse direction relative to the first beam, said first beam being disposable in said floor portion; and a coupling member, the plurality of substantially T-shaped anchor members being coupled to the coupling member at respective longitudinal ends of the second beams such that the substantially T-shaped anchor members are arranged in a cluster with the coupling member being disposed substantially centrally of the anchor members and with said second beams extending substantially radially of the coupling member; and a linking member attached to the coupling member;

whereby, in use, when said first beams of said anchor members are driven into said floor portion and a load is applied to said linking member, the load is offset from a longitudinal axis of each said first beam thereby increasing the holding power of said anchoring system;

wherein the coupling member comprises a triangular fish plate.

6. An underwater anchoring system for anchoring objects to a floor portion of a body of water, the system comprising:

a plurality of substantially T-shaped anchor members arranged in a cluster, each anchor member having an elongate first beam and an elongate second beam, the second beam having longitudinal ends and extending in a substantially transverse direction relative to the first beam, said first beam being disposable in said floor portion; and a coupling member, the plurality of substantially T-shaped anchor members being coupled to the coupling member at respective longitudinal ends of the second beams such that the substantially T-shaped anchor members are arranged in a cluster with the coupling member being disposed substantially centrally of the anchor members and with said second beams extending substantially radially of the coupling member; and a linking member attached to the coupling member;

whereby, in use, when said first beams of said anchor members are driven into said floor portion and a load is applied to said linking member, the load is offset from a longitudinal axis of each said first beam thereby increasing the holding power of said anchoring system;

wherein a transverse plate is provided on the first beam substantially perpendicular to the plane of the second beam so as to provide resistance to transverse movement of the anchor member in a direction parallel to the plane of the anchor member; and wherein three of the anchor members are provided, said second beams being disposed substantially equidistantly relative to the coupling member with each second beam arranged radially at an angle of substantially 120° with respect to an adjacent second beam.

* * * * *